United States Patent [19]

Zinn et al.

[11] Patent Number: 4,986,770

[45] Date of Patent: Jan. 22, 1991

[54] ELECTRICAL EXTERNAL CONNECTOR

[75] Inventors: Bernd Zinn, Ennepetal; Srboslav Lolic, Wuppertal, both of Fed. Rep. of Germany

[73] Assignee: Grote & Hartmann GmbH & Co. KG, Fed. Rep. of Germany

[21] Appl. No.: 395,641

[22] Filed: Aug. 18, 1989

[30] Foreign Application Priority Data

Sep. 22, 1988 [DE] Fed. Rep. of Germany ... 8812014[U]

[51] Int. Cl.[5] ..... H01R 13/436

[52] U.S. Cl. ..... 439/752

[58] Field of Search ..... 439/595, 733, 752, 744, 439/869, 871

[56] References Cited

U.S. PATENT DOCUMENTS

| | | | |
|---|---|---|---|
| 4,690,477 | 9/1987 | Doutrich et al. | 439/595 |
| 4,772,229 | 9/1988 | Nix et al. | 439/733 |
| 4,902,247 | 2/1990 | Suzuki et al. | 439/595 |

FOREIGN PATENT DOCUMENTS

| | | | |
|---|---|---|---|
| 1790043 | 12/1971 | Fed. Rep. of Germany . | |
| 2510812 | 3/1976 | Fed. Rep. of Germany . | |
| 2704760 | 8/1977 | Fed. Rep. of Germany | 439/595 |
| 2930658 | 3/1980 | Fed. Rep. of Germany . | |
| 2942569 | 4/1980 | Fed. Rep. of Germany . | |
| 3129405 | 4/1982 | Fed. Rep. of Germany . | |
| 3340654 | 5/1986 | Fed. Rep. of Germany . | |
| 3706975 | 9/1987 | Fed. Rep. of Germany . | |
| WO8803715 | 5/1988 | PCT Int'l Appl. . | |
| 1491217 | 11/1977 | United Kingdom | 439/733 |

*Primary Examiner*—Gary F. Paumen

*Attorney, Agent, or Firm*—Jones, Askew & Lunsford

[57] ABSTRACT

An external connector with an additional lock for a multipolar electrical coupling. The connector includes consisting largely of a connector housing and an additional locking element, with the connector housing possessing contact element chambers organized next to each other in a line, each chamber having a connector opening in the bottom and an opposite insertion opening, with a slider core opening being located preferably next to the connector opening, and with the additional locking element being equipped with a bottom plate that forms the connector profile of the external connector, and with vertical flexible spring locking tongues being spaced parellel to each other along the bottom plate of the additional locking element, which in turn is set against the bottom wall of the external connector housing, and with these flexible spring locking tongues being equipped with detents on their upper unconnected ends, and the detents each penetrating a recess opening, providing access through the chamber wall to one of the chambers of the connector housing.

17 Claims, 2 Drawing Sheets

ELECTRICAL EXTERNAL CONNECTOR

FIELD OF THE INVENTION

The invention concerns an electrical external connector with an additional lock for a multipolar, specifically, a waterproof coupling.

BACKGROUND OF THE INVENTION

Most electrical connectors are equipped with a single additional lock slider, which is inserted into the connector housing by the narrow side and thereby grips or locks the corresponding edges or similar elements of all the electrical contacts located in the contact chambers. Such a lock is not possible when, inside the connector housing, the contact chambers are positioned on a vertical axis at an angle to each other. In addition, this locking method is not possible with waterproofed electrical external connectors whose housing is to penetrate an opening in a wall in such a manner as to be watertight, if the narrow sides of the connector housing are covered with a seal and the lock slider cannot be repositioned.

With the previously known connector housings, the lock slider can only be inserted once all of the contact elements have been installed into the contact chambers. In the meantime, care must be taken that the contact elements do not slip out of the chambers or slide askew inside the chambers during assembly, which complicates the installation of the connector. The lock slider also makes it impossible to insert the contact elements into the chambers when the lock slider is actuated, which makes installation of the connector difficult.

Certain connector housings with internal primary locking through the metal tongues of a contact require that the necessary cutout in the housing be implemented from beneath, i.e. from the so-called connector profile, using the slider cores. This creates a second, laterally displaced opening for the slider core, positioned next to and extending into the connector opening. In solutions that up until now have not been waterproof, an outer housing with the desired connector profile was used in order to avoid accidental connections between the contact pins to be inserted into the connector housing and the contact elements located within the connector housing. The slider core opening is thereby covered up by the bottom plate of the outer housing. This effect, as well as the additional external lock, are attained through the use of a bottom plate equipped with detent grips.

The possibility of installing contacts into the chambers after assembly of the additional lock, which does not confine itself solely to the waterproofed embodiments, does not apply to these known connector versions.

Aside from bar-shaped lock sliders, comb-like lock sliders are known, which, however, possess the same disadvantages as the bar-shaped lock sliders.

SUMMARY OF THE INVENTION

The purpose of the invention is to create an additional lock that functions both with connector housings containing contact chambers which face each other at an angle, as well as with contact chambers organized evenly in rows; this additional lock should simultaneously cover the slider core opening on quadratic connector openings, as well as additionally allow the insertion of the connector contacts after assembly of the additional lock.

BRIEF DESCRIPTION OF DRAWINGS

The invention is further explained by means of the example illustrated in the figures. The figures show the following.

DESCRIPTION OF PREFERRED EMBODIMENT

Figures 1, 2, 3, 4, 5:
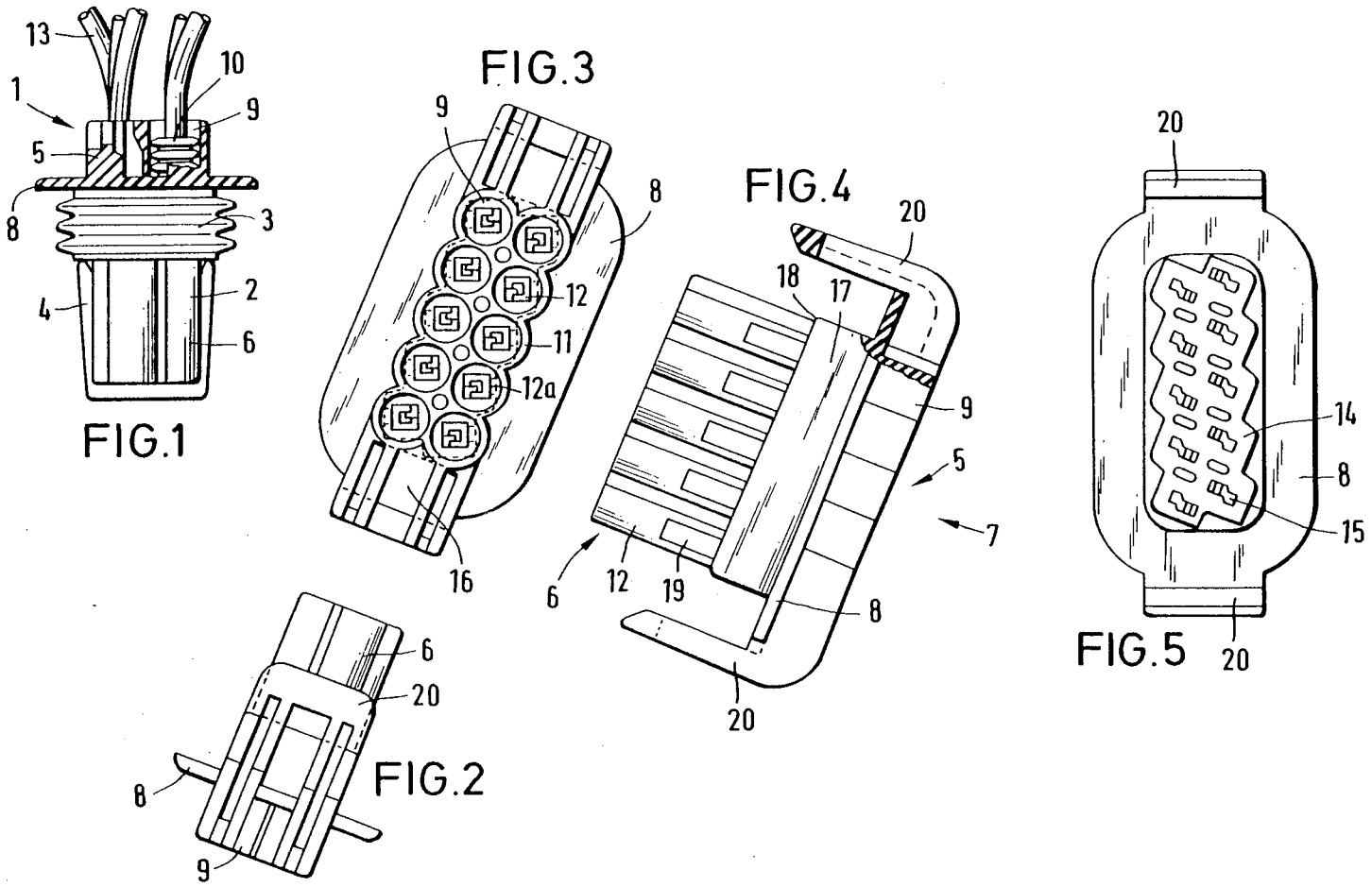
FIG. 1 a front view of the external connector, with partial cross section.
FIG. 2 a front view of the external connector housing.
FIG. 3 a top view of the external connector housing.
FIG. 4 a side view of the external connector housing.
FIG. 5 a bottom view of the external connector housing.
Figure 6:
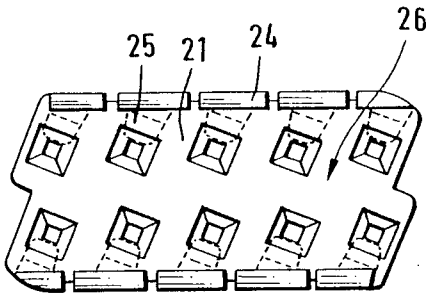
FIG. 6 a bottom view of the additional locking element.
Figure 9:
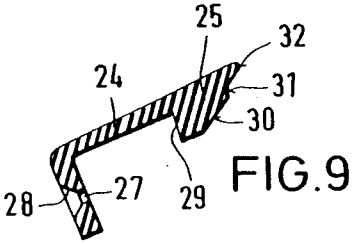
FIG. 9 a cross-sectional view of the line IX—IX in FIG. 7 in the direction of the arrow, and FIG. 10 a cross-sectional view of the line X—X in FIG. 7 in the direction of the arrow.
Figure 8:
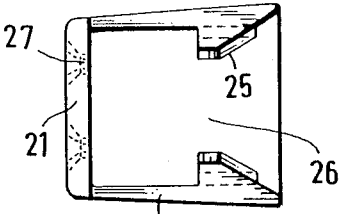
FIG. 8 a front view of the additional locking element.
Figure 7:
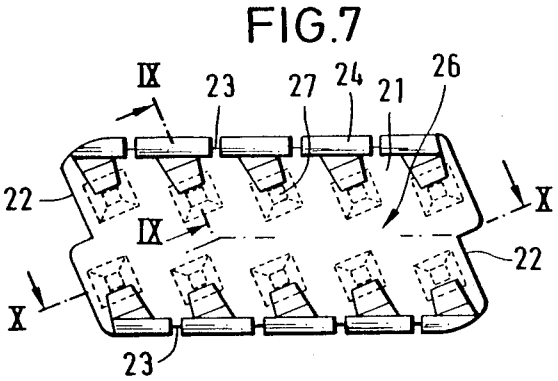
FIG. 7 a top view of the additional locking element.
Figure 10:
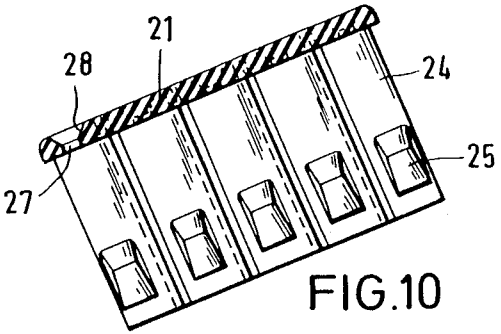

The external connector 1 is plastic and is comprised largely of the connector housing 2, the connector seal 3, and the additional locking element 4.

The particular one-piece connector housing illustrated in FIGS. 2 to 5 consists of the seal chamber housing part 5 and the contact chamber housing part 6, which are lined up in the connecting direction 7 (FIG. 4) and which provide a surrounding protruding external grip and/or connection terminator rail 8 in the transitional area.

Cylindrical chambers 9 are positioned in the seal chamber housing part 5 for the reception of single line seals 10, which (as illustrated) can have a wavy external contour 11 (FIG. 3). Chambers 12 with a preferably quadratic cross section are situated in the contact chamber housing part 6 flush with chambers 9 and receive contact elements crimped onto electrical lines 13, i.e., stampings (not illustrated), with the chambers 12 being terminated on the end opposite chambers 9 by a bottom wall 14 with connector openings 15 for opposing connector contact elements (not illustrated), as well as by neighboring slider core openings which extend into the corresponding connector openings (FIG. 5). Edges 12*a* of chambers 12 in housing part 6 are arranged at an angle to platform 16.

A flat ring surface 17 is located beneath the rail 8 (viewed in connecting direction 7) upon which rests the connector seal 3 (composed of, for example, rubber) which is shoved against the bottom of rail 8. The housing part 6 is connected to the ring surface 17 and continued over a narrow ring edge 18 of reduced cross-section, whereby square recess openings 19 arranged next to each other--provide access to each chamber 12. The recess openings 19 begin in the area of the ring edge 18 and end a considerable distance from the bottom wall 14.

One U-shaped detent spring clamp 20 is mounted frontally in the area of the seal chamber housing part 5, pointing toward the connecting direction 7 and extending over the connector seal 3 which interacts with the counter detention devices (not illustrated).

The additional locking element 4 is equipped with a bottom plate 21 which has two front edges 22 and two longitudinal edges 23 and holds the connector profile of the connector.

Vertical standing flexible spring locking tongues 24 are spaced parallel to each other along the longitudinal edges 23 and are equipped with detents 25 in the unconnected upper end region. The detents 25 point towards the inner area 26 of the additional locking element 4. A connector opening 27 in the bottom plate 21 is located under each detent 25, with an insertion funnel pointing out. The detents 25 are angled away from the locking tongues 24 in the illustrated example, which reflects the rotated position of the chambers 12.

It is essential that the additional locking element 4 be set against the bottom wall 14 of the external connector housing, such that the connector openings 27 lie flush with the connector openings 15 of the external connector housing, the slider core openings 15*a*, are covered, and the detents 25 protrude into the recess openings 19. Through this process, the additional locking element 4 is mounted securely on the external connector housing.

The detents 25 are characterized by a particular shape, such that a detent edge 29 is aligned at a right angle down towards the inner area 26, with the detent edge being longer than the thickness of a chamber 12 wall; thus, the edge 29 penetrates the inner area of a chamber 12 and can thereby operate as an additional locking edge. The edge 29 is able to grip the corresponding edge of an electrical connector or contact element (not illustrated) inserted into chamber 12, thereby implementing the additional lock.

The unconnected edges of the detents 25 have a diagonal 30 and an adjacent counter edge 31, with the diagonal 30, as is known, facilitating the sliding of the additional locking element onto the external connector housing, and the counter edge 31 butting up against the upper edge of a recess opening 19, such that the edges 29 and 31——viewed in connecting direction 7——ensure secure mounting of the additional locking element 4. The length of a detent 25 therefore corresponds to the length of a recess opening 19. The detents 25 have rounded points 32 on the ends which stand up from the wall of the external connector housing and can be used to bend back the corresponding spring tongue 24 either by hand or with a tool in order to remove a contact element from a contact chamber 12. At the same time, the connector seal 3 is supported on the points 32, which prevents it from slipping.

According to the invention, contact elements can be installed in the external connector equipped with the additional locking element, with the spring tongues 24 being retractable and able to spring back behind a detent or locking edge of the contact element. The installation of contact elements in the chambers 12 is simple and can be done by machine. Each contact element is individually locked and securely retained after installation. This results, through simple means, in the creation of a waterproof external connector equipped with a special additional lock which requires little assembly effort and allows for additional locking even when chambers with a quadratic or square cross section are arranged in the housing, rotated around their longitudinal axes in relation to the housing walls.

We claim:

1. External connector with an additional lock for a multipolar electrical coupling, the connector including a connector housing and an additional locking element, with the connector housing having contact element chambers (9) organized next to each other in a line, each chamber having a connector opening in the bottom and an opposite insertion opening, with a slider core opening being located adjacent the connector opening, and with the additional locking element having a bottom plate that forms the connector profile of the external connector, characterized by:

vertical flexible spring locking tongues (24) spaced parallel to each other along the bottom plate (21) of the additional locking element (4), which in turn is set against a bottom wall (14) of the connector housing, with the flexible spring locking tongues having upper unconnected ends equipped with detents (25); and the detents (25) each penetrating a recess opening (19) providing access through the chamber wall to one of the chambers (12) of the connector housing (2).

2. External connector according to claim 1, wherein the detents (25) are each equipped with a detent edge (29) pointing inward towards a respective chamber (12) at a right angle, the detent edge (29) being longer than the thickness of the wall of the chamber (12), thereby causing the detent edge (29) to penetrate the inner area of the chamber (12) and create an additional locking edge.

3. External connector according to claim 1, wherein the locking tongues (24) are arranged along longitudinal edges (23) of the bottom plate (21).

4. External connector according to claim 1, wherein each connector opening (27) is positioned underneath its respective detent (25) in the bottom plate (21) with an insertion funnel of each opening pointing outwardly.

5. External connector according to claim 1, wherein the recess openings (19) are square and arranged next to each other.

6. External connector according to claim 1, wherein the connector openings (27) abut connector openings (15).

7. External connector according to claim 1, wherein the unconnected ends of the detents (25) have a diagonal (30) and an adjacent counter edge (31).

8. External connector according to claim 7, wherein each counter edge (31) butts up against the upper edge of its respective recess opening (19).

9. External connector according to claim 1, wherein the length of a said detent (25) corresponds to the length of said recess opening (19).

10. External connector according to claim 1, wherein the detents (25) each possess a rounded point (32) on an end thereof, which stands up from the bottom wall of the external connector housing.

11. External connector according to claim 10, with the connector housing being equipped with a seal chamber housing part with chambers and a contact chamber housing part having said chambers (9), with the housing parts as well as the chambers lying flush together in a certain connecting direction (7), wherein:

a connector seal (3) is mounted externally in a transitional area between the seal chamber housing part (5) and the contact chamber housing part (6), and that the additional locking element (4) is positioned against the bottom wall (14) of the external connector housing and is securely fastened to the external connector housing.

12. External connector according to claim 11, wherein a surrounding protruding external grip-rail (8) is positioned in the transitional area between the seal chamber housing part (5) and the contact chamber housing part (6).

13. External connector according to claim 11, wherein the chambers (9) are cylindrically constructed to receive single line seals (10) and the chambers (12) with a substantially quadratic cross section are positioned flush with the chambers (9) and serve to receive contact elements crimped only electrical lines (13), with the chambers (12) being terminated on the end opposite the chamber (9) by the bottom wall (14) containing connector openings (15) for opposing connector contact elements.

14. External connector according to claim 12, wherein a flat ring surface (17) is positioned beneath the grip-rail (8), upon which rests the connector seal (3) comprised of an elastomer, the connector seal being urged against the bottom grip rail (8).

15. External connector according to claim 14, wherein the housing part (6) is connected to the ring surface (17) and continued over a narrow ring edge (18) and that the connector seal (3) is supported on the rounded points (32) of the detents (25).

16. External connector according to claim 4, wherein the chambers (12) are square and organized in a row next to each other, but positioned at an angle towards each other, the connector openings (15) as well as the slider core openings and the connector openings (27) are mutually aligned the detents (25) are angled away from the locking tongues (24), which corresponds to the angled position of the chambers (12), and the recess openings (19) are also positioned at an angle pointing towards the chambers (12).

17. External connector according to claim 14, further comprising a U-shaped detent spring clamp (20) mounted frontally on each end of the seal chamber housing part (5), pointing towards the connecting direction (7) and extending over the connector seal (3).

* * * * *

UNITED STATES PATENT AND TRADEMARK OFFICE

CERTIFICATE OF CORRECTION

PATENT NO. : 4,986,770

DATED : January 22, 1991

INVENTOR(S) : BERND ZINN ET AL.

It is certified that error appears in the above-identified patent and that said Letters Patent is hereby corrected as shown below:

Column 5, line 8, change "only" to --onto--.

Column 5, line 17, after "bottom" insert --of the--.

Signed and Sealed this

Seventh Day of July, 1992

*Attest:*

DOUGLAS B. COMER

*Attesting Officer*

*Acting Commissioner of Patents and Trademarks*